United States Patent [19]

Buffington

[11] Patent Number: 4,898,383

[45] Date of Patent: Feb. 6, 1990

[54] AMUSEMENT APPARATUS

[76] Inventor: Larry J. Buffington, 611 N. Summit Rd., Benton, Ark. 72015

[21] Appl. No.: 364,146

[22] Filed: Jun. 12, 1989

[51] Int. Cl.[4] ..... A63F 9/06

[52] U.S. Cl. ..... 273/1 G; 273/DIG. 31

[58] Field of Search ..... 273/19, DIG. 31, DIG. 25

[56] References Cited

U.S. PATENT DOCUMENTS 777,205 12/1904 Henry ..... 273/DIG. 31 X 1,545,569 7/1925 Newton ..... 273/DIG. 31 X

*Primary Examiner*—Paul E. Shapiro

*Attorney, Agent, or Firm*—Donald A. Kettlestrings

[57] ABSTRACT

Amusement apparatus for use as a game or for improving manual dexterity includes an undulant support surface defining a plurality of substantially parallel, alternating rounded grooves and rounded ridges and a plurality of substantially identical, round, saucer-shaped, nesting elements for positioning within the grooves and for manually manipulating among the grooves and over the ridges.

8 Claims, 3 Drawing Sheets

AMUSEMENT APPARATUS

This invention relates to amusement apparatus and more particularly to amusement apparatus for use as a game or for improving manual dexterity.

An object of the present invention is to provide amusement apparatus which is easy and inexpensive to manufacture.

Another object is to provide amusement apparatus which will enhance and improve manual dexterity.

A further object of the invention is the provision of amusement apparatus which can be used as a game.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the claims.

The accompanying drawings, which are incorporated in and constitute a part of this specification, illustrate examples of preferred embodiments of the invention and, together with the description, serve to explain the principles of the invention.

Figure 2:
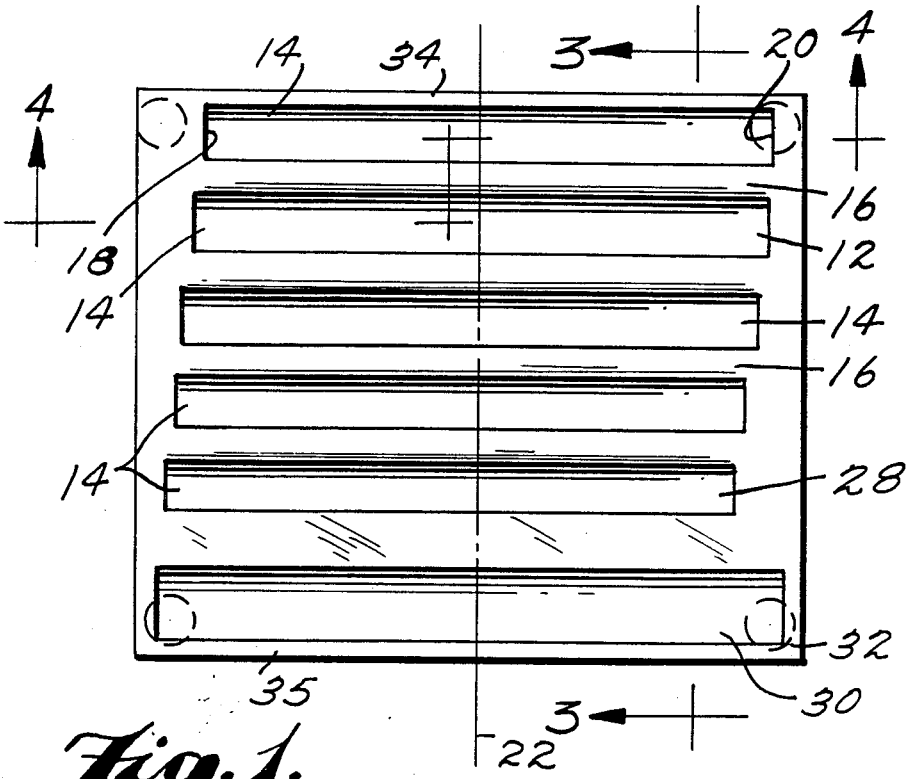
FIG. 2 is a top plan view of the apparatus.

With references now to the drawings, wherein like reference characters designate like or corresponding parts throughout the several views, there is shown amusement apparatus 10 which includes an undulant support surface 12. Surface 12 defines a plurality of substantially parallel, alternating, rounded grooves 14 and rounded ridges 16. A first end wall 18 defines a first end of each of grooves 14, and a second end wall 20 defines a second end of each of grooves 14. The distance between end walls 18, 20 within each of grooves 14 is substantially equal.

Surface 12 defines an imaginary axis 22, and first end walls 18 are located at progressively greater distances from axis 22 from a first one of grooves 14, adjacent to first end 34 of surface 12, to a last one of grooves 14, adjacent to second end 35 of surface 12. Similarly, second end walls 20 are located at progressively smaller distances from axis 22 from the first one of grooves 14 to the last one of grooves 14.

In accordance with the invention, a plurality of substantially identical, round, saucer-shaped nesting elements 24 are provided for positioning within grooves 14 and for manually manipulating among the grooves and over ridges 16. Nesting elements 24, when positioned in nesting relationship with each other, form a substantially cylindrical unit 26 having a length less than the distance between end walls 18, 20 of each of grooves 14. Further, the height of each of ridges 16 above the bottom 28 of each adjacent groove 14 is substantially one-third the diameter of each of elements 24 to enable nested elements 24, which form unit 26, to be "snaked" over ridges 16 and among grooves 14. Each of ridges 16, in any event, should be no greater than approximately three-quarters inch to one inch in height to make it easy to transfer unit 26 among grooves 14 and over ridges 16.

Figure 11:
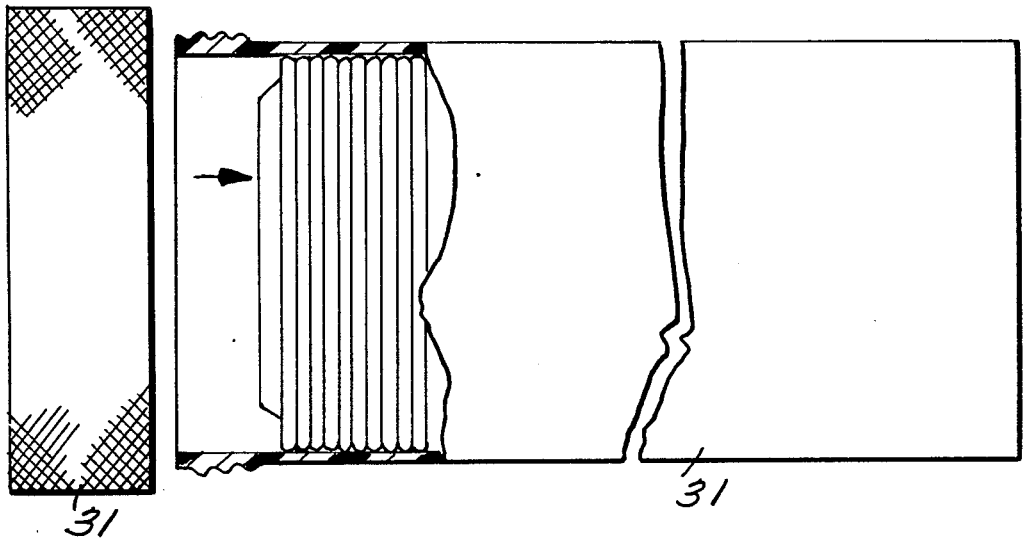
FIG. 11 is a fragmentary top plan view, partly in section, showing a separate container for holding a plurality of nesting elements when the apparatus is not in use.

A storage container 30 is preferably attached to support surface 12 for receiving and storing elements 24 when apparatus 10 is not in use. A cover (not shown) can be used to cover container 30. Alternatively, a separate storage container 31 (FIG. 11) may be used to store elements 24. Suction cups 32 are preferably attached to an underside of support surface 12 for enabling apparatus 10 to be firmly attached to a table or the like during use.

In operation, unit 26 of nesting elements 24 is preferably placed into a first groove 14 adjacent to end 34 of support surface 12, and the concave sides of elements 24 are positioned to face toward wall 20. Unit 26 of nested elements 24 has a length less than the distance between end walls 18, 20, and unit 26 is positioned within groove 14 so that end 36 of unit 26 abuts wall 18 and a space is permitted between end 38 of unit 26 and end wall 20. As viewed in FIG. 1, the operator is positioned adjacent to end 35 of surface 12, and a finger or fingers of the operator's right hand is inserted into the space between end 38 and wall 20. Appropriate movements of the finger or fingers will cause unit 26 to roll or "snake" from within groove 14 over ridge 16 and into an adjacent groove 14. The finger movement is then repeated until unit 26 of nesting elements 24 has been transferred to the last groove 14 adjacent to end 35 of surface 12.

The round, saucer-shaped configuration of each of elements 24 permits the elements to nest with respect to each other. This feature and the height of ridges 16 permits unit 26 to be "snaked", rolled or transferred among grooves 14 and over ridges 16 in the manner described. A level of skill is required to accomplish transfers of unit 26 among grooves 14 without causing elements 24 to become separated from each other. If a person is not skilled or practiced in operating apparatus 10, discs 24 will become separated from each other and will no longer form a unit 26 which can be moved among grooves 14. Practice will enable the user to learn the manual movements necessary to accomplish movement of unit 26 among grooves 14 in the manner described.

The positioning of walls 18, 20 with respect to axis 22, as previously described, also is an important feature of apparatus 10 which permits unit 26 to be moved sequentially from one groove 14 to another. The use of suction cups 32 or other equivalent devices is also important because surface 12 must be held in a stationary position during operation of the apparatus.

Figure 1:
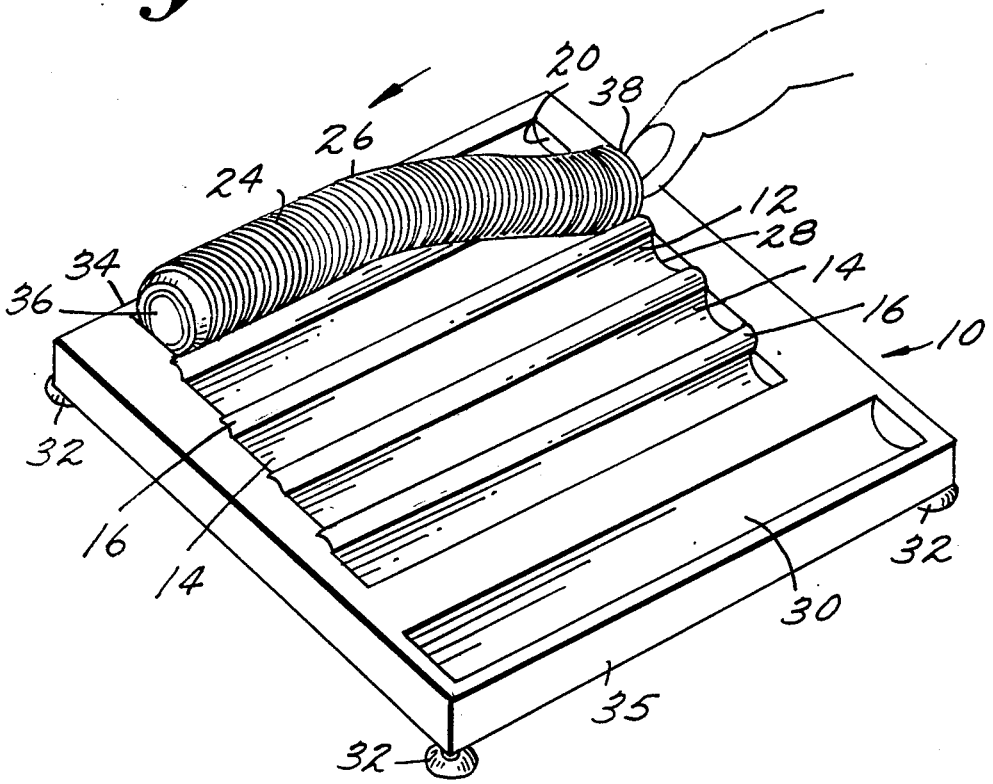
FIG. 1 is a perspective view of the apparatus and illustrating its use.
Figure 3:
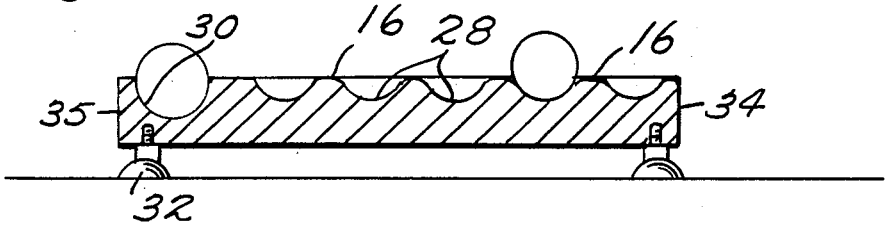
FIG. 3 is a cross-sectional view of the apparatus taken substantially along the line 3—3 in FIG. 2 and looking in the direction of the arrows.
Figure 4:
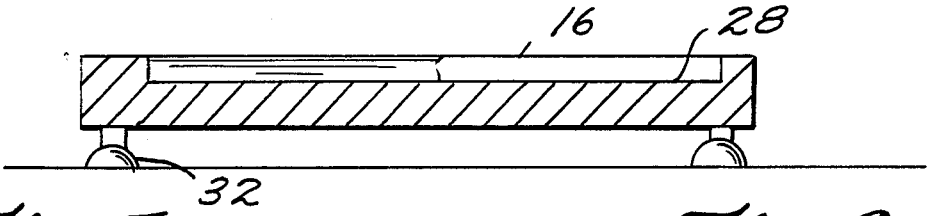
FIG. 4 is a cross-sectional view of the apparatus taken substantially along the line 4—4 in FIG. 2 and looking in the direction of the arrows.
Figure 5:
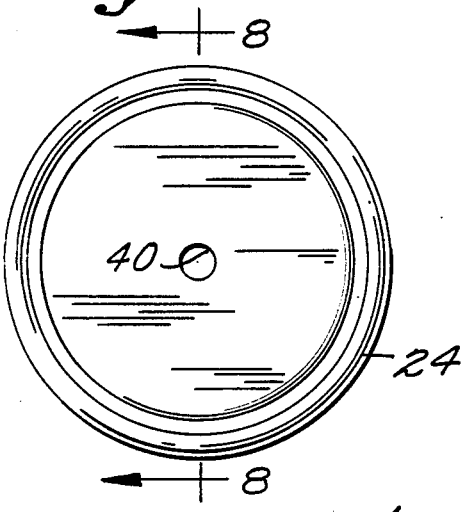
FIG. 5 is a front elevation view of a nesting element.
Figure 6:
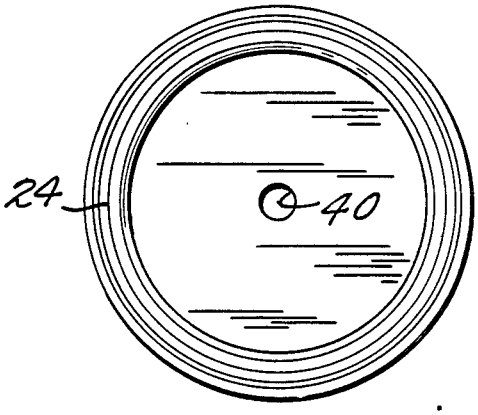
FIG. 6 is a rear elevation view of a nesting element.
Figure 7:
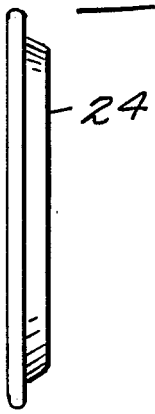
FIG. 7 is a side elevation view of a nesting element.
Figure 8:
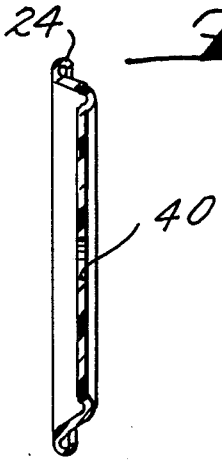
FIG. 8 is a cross-sectional view of the nesting element in FIG. 5 taken substantially along the line 8—8 and looking in the direction of the arrows.

After unit 26 of nested elements 24 has been transferred from first groove 14, adjacent to first end 34 of the apparatus, to last groove 14, adjacent to second end 35, unit 26 can be turned around one hundred eighty degrees from the position shown in FIG. 1. A finger or fingers of the operator's left hand can then be inserted into the space between end 36 of unit 26 and wall 18. Appropriate movements of the finger or fingers will cause unit 26 to roll or "snake" from within groove 14, adjacent to end 35, over ridge 16 and into adjacent groove 14. The finger movements are then repeated until unit 26 has been transferred back to groove 14 adjacent to end 34.

Figure 9:
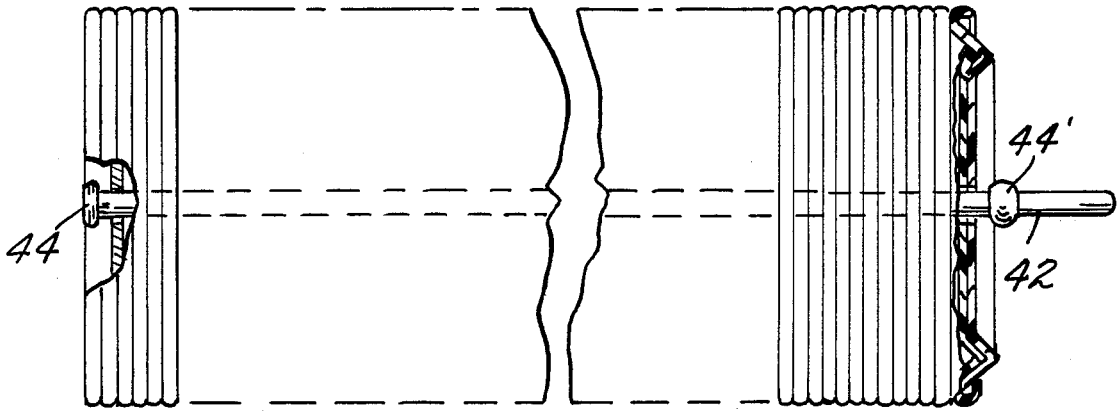
FIG. 9 is a diagrammatic top plan view, partly in section, showing a plurality of nesting elements held in position by means of a strip or cord.
Figure 10:
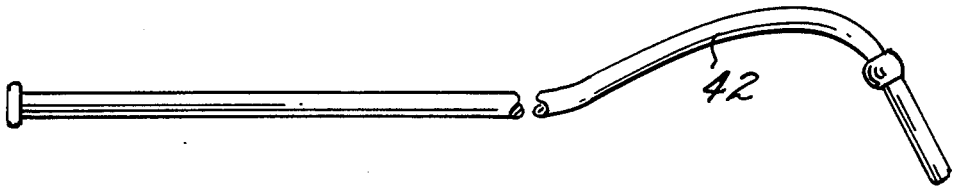
FIG. 10 is a fragmentary plan view of the strip.

An alternative embodiment of the invention is illustrated in FIGS. 9 and 10 wherein each of elements 24 defines an opening 40 substantially in the center thereof. A flexible strip or cord 42 passes through openings 40, and knots 44, 44' are provided adjacent to ends of strip 42 for retaining elements 24 in substantially nesting relationship with each other. Knots 44, 44' are positioned sufficiently apart from each other to enable elements 24 and unit 26 to be moved among grooves 14 and over ridges 16 in the manner previously described. The use of strip 42 and of knots 44, 44' prevents scattering of elements 24 if the operator is unskilled at maneuvering elements 24 and unit 26 as previously described. The use of strip 42 enables an operator to become accustomed to the movements required for successful transfer of unit 26 among grooves 14 without scattering elements 24. After the operator has learned the procedure, strip 42 can be removed from discs 24 and unit 26 can be maneuvered among grooves 14 and over ridges 16, as previously described, without the use of strip 42.

Apparatus 10 can be used as a game in which the person who transfers unit 26 the fastest without mishap would be the winner of the game.

It is preferred that support surface 12 and elements 24 be constructed of a plastic material, but any other lightweight and durable material may be used. The offset of each end wall 18 and of each end wall 20 is preferably substantially one inch from one groove 14 to the next. Experience has shown that this permits transferring of unit 26 among grooves 14 in an optimum manner and without spilling or losing control of elements 24. A person skilled in maneuvering unit 26 among grooves 14 should be able to maneuver unit 26 from one end of support surface 12 to the other within eight to ten seconds. Typically, there will be from one hundred fifty to one hundred seventy-five elements 24 within unit 26, depending on the thickness of elements 24. Each of elements 24 may be approximately one-eighth inch in thickness, the playing area of surface 12 may be from twenty-four to twenty-eight inches square, and each element 24 may be approximately two and one-half inches in diameter.

The invention in its broader aspects is not limited to the specific details shown and described, and departures may be made from such details without departing from the principles of the invention and without sacrificing its chief advantages.

What is claimed is:

1. Amusement apparatus, comprising:

an undulant support surface defining a plurality of substantially parallel, alternating, rounded grooves and rounded ridges;

a first end wall defining a first end of each of said grooves and a second end wall defining a second end of each of said grooves, the distance between said first end wall and said second end wall within each of said grooves being substantially equal;

said surface defining an axis;

said first end walls located at progressively greater distances from said axis from a first one of said grooves to a last one of said grooves, and said second end walls located at progressively smaller distances from said axis from said first one of said grooves to said last one of said grooves; and a plurality of substantially identical, round, saucer-shaped, nesting elements for positioning within said grooves and for manually manipulating among said grooves and over said ridges.

2. Apparatus as in claim 1 wherein said plurality of nesting elements when positioned in nesting relationship with each other form a substantially cylindrical unit having a predetermined length less than said distance between said end walls of each of said grooves.

3. Apparatus as in claim 2 wherein the height of each of said ridges above the bottom of each adjacent groove is substantially one-third the diameter of each of said elements.

4. Apparatus as in claim 3 further including a storage container attached to said support surface for receiving and storing said elements when the apparatus is not in use.

5. Apparatus as in claim 3 further including suction cups attached to said support surface for enabling said apparatus to be firmly attached to a table or the like during use.

6. Apparatus as in claim 3 wherein each of said elements defines an opening substantially in the center thereof and further including a flexible strip passing through said openings and means attached to said strip for retaining said elements in substantially nesting relationship with each other.

7. Apparatus as in claim 6 further including a storage container attached to said support surface for receiving and storing said elements when the apparatus is not in use.

8. Apparatus as in claim 6 further including suction cups attached to said support surface for enabling said apparatus to be firmly attached to a table or the like during use.

* * * * *